United States Patent [19]

Katz et al.

[11] Patent Number: 5,018,991

[45] Date of Patent: May 28, 1991

[54] FUSE HOLDER ASSEMBLY

[75] Inventors: Paul C. Katz, Chicago; Patrick A. Pisciotto, Wood Dale; Gary I. Robin, Niles, all of Ill.

[73] Assignee: Triplex Manufacturing Co., Chicago, Ill.

[21] Appl. No.: 522,326

[22] Filed: May 11, 1990

[51] Int. Cl.[5] ..... H01R 13/68

[52] U.S. Cl. ..... 439/621; 337/205

[58] Field of Search ..... 439/620–622, 439/271; 337/187, 188, 190, 205, 213

[56] References Cited

U.S. PATENT DOCUMENTS

| | | | |
|---|---|---|---|
| 1,969,301 | 8/1934 | Edwards | 337/201 X |
| 2,666,805 | 1/1954 | Smith | 174/153 |
| 2,841,635 | 7/1958 | Witzell et al. | 174/77 |
| 3,301,197 | 1/1967 | Fister | 200/120 |
| 3,321,733 | 5/1967 | Thomas | 339/90 |
| 3,356,806 | 12/1967 | Urani | 337/205 X |
| 3,551,869 | 12/1970 | Robinson | 337/201 |
| 3,778,741 | 12/1973 | Schmidt, Jr. | 337/201 |
| 4,734,059 | 3/1988 | Mewgin | 439/621 |
| 4,909,761 | 3/1990 | Muguira | 357/201 X |

*Primary Examiner*—Eugene F. Desmond

*Attorney, Agent, or Firm*—Fitch, Even, Tabin & Flannery

[57] ABSTRACT

A fuse holder assembly for a cylindrical fuse of the type including a fusible link retained in an insulative sleeve. The assembly includes first and second insulated conductors, first and second metallic terminal elements for attachment to the end of the conductors and including a receiving end for holding one end of the fuse. The assembly further includes first and second sleeves of resilient insulative material for receiving corresponding conductors in an interference fit with each sleeve being slidable along the outside surface of the conductor. A first cap of relatively rigid insulative material includes a barrel defining a cavity for receiving the first terminal element with the cap having a facing end portion and a remote end portion. The cap includes an intermediate internal ledge positioned between the end portions for abutting the fuse-receiving end of the terminal element, and a remote internal ledge positioned at the remote end portion of the cap for abutting a sleeve. The remote ledge defines an opening for passage of the first conductor. A substantially similar second cap is also provided for longitudinal movement towards the first cap thereby causing the fuse to be received in the fuse-receiving portions of the terminal elements and with the sleeves bearing against their corresponding remote ledges of the caps, to provide a degree of water resistance.

9 Claims, 2 Drawing Sheets

20
22
24
26
28
30
32
34
36
38
40
42
44
48
50
52
54
56
58
60
62
64
66
68
70
73
74
88
92

FUSE HOLDER ASSEMBLY

This invention relates to holders for electrical components and, more particularly, to an in-line holder for a cylindrical fuse having a glass or ceramic body.

BACKGROUND OF THE INVENTION

Cylindrical fuses of the type having an insulative body made of a material such as glass or a ceramic have been used for many years, particularly in automotive applications. Such fuses include a fusible link retained in the body or sleeve and connected to metallic end cups held at the ends of the sleeve. Two types of holders are generally used for such fuses. In the insertion type holder, two spaced pairs of terminal spring arms are provided with the pairs being spaced for alignment with the fuse end cups. The fuse is inserted by downward movement, causing the resilient arms to deflect until the fuse is fully received by the holder. In the in-line type holder, two plastic caps are provided with a terminal held in each cap and the conductor connected to each terminal extending through the end wall of the cap. The fuse is, for example, placed in one plastic cap and the other cap is moved longitudinally toward the one cap until the caps engage. The plastic caps may be provided with interlocking arms so that after the caps engage they can be twisted causing the arms to lock the caps thereby encapsulating the fuse. These in-line holders typically include a spring located inside one of the plastic caps for urging the terminals against the end cups of the fuse.

These prior art fuse holders can permit the entrance of moisture. This could result in corrosion of the metallic fuse end cups, the terminals for engaging the end cups and/or the spring. Furthermore, in an extreme situation the moisture could result in current shunting or bypassing the fuse thus defeating the purpose of the fuse and creating a potential safety hazard.

U.S. Pat. No. 3,778,741 to Schmidt, Jr. shows an in-line fuse holder including a pair of plastic caps with locking fingers permitting the caps to be joined by twisting. One cap holds a spring which bears against the inner surface of the end of the cap. U.S. Pat. No. 3,551,869 to Robinson is directed to a fuse holder including a pair of caps with one cap having an annular nose sized for reception in a bore in the other cap.

U.S. Pat. No. 3,301,979 to Fister discloses an O-ring which is compressed between components of a fuse holder against the inside surface of an outer wall. Operation of the O-ring is discussed in Col. 4, 11. 22–47. U.S. Pat. No. 3,321,733 to Thomas shows O-rings used for insulation in a high voltage connector to define a longer creepage path thereby eliminating corona discharge. U.S. Pat. No. 2,666,805 to Smith and U.S. Pat. No. 2,841,635 to Witzell et al. are directed to leakproof terminals and connections therefor.

SUMMARY OF THE INVENTION

Among the several aspects and features of the present invention may be noted the provision of an improved in-line fuse holder. The holder is chiefly made of inexpensive molded thermoplastic components and metallic components formed by cutting and bending a blank. The holder offers a degree of water resistance not only at the ends of the plastic caps but also at the location where the caps engage each other. The glass-bodied fuse is firmly held by the holder without the need for a separate spring to push the fuse against the opposite terminal. Furthermore, the holder continues to firmly retain the fuse upon separation of the plastic caps to provide additional protection for the relatively fragile fuse. The holder of the present invention is dependable in use, has long service life, and is relatively easy and inexpensive to manufacture. Other aspects and features of this invention will be in part apparent and in part pointed out specifically in the specification and accompanying drawings.

Briefly, the fuse holder assembly includes first and second insulated conductors each having a conductive core and an outer jacket positioned about the core. First and second metallic terminal elements each include a larger end for slidably receiving one of the terminal cups of the fuse and a smaller end for attachment to the core of a corresponding conductor. A first sleeve of resilient insulative material receives the first conductor in an interference fit but with the sleeve being slidable on the outer surface of the jacket of that conductor. A second sleeve is similarly provided for receiving the other conductor. The fuse holder assembly includes first and second caps of relatively rigid insulative material. Each cap has a barrel defining a cavity for receiving one of the terminal elements and each cap has a facing end portion and a remote end portion. An intermediate internal ledge is positioned between the end portions for abutting the larger end of the terminal element and a remote internal ledge is located at the remote end portion of the cap for abutting the corresponding sleeve. The remote ledge defines an opening for passage of the associated conductor.

BRIEF DESCRIPTION OF THE DRAWINGS

Corresponding reference numerals indicate corresponding components throughout the several views of the drawings.

DESCRIPTION OF THE PREFERRED EMBODIMENT

Figures 1, 2, 3:
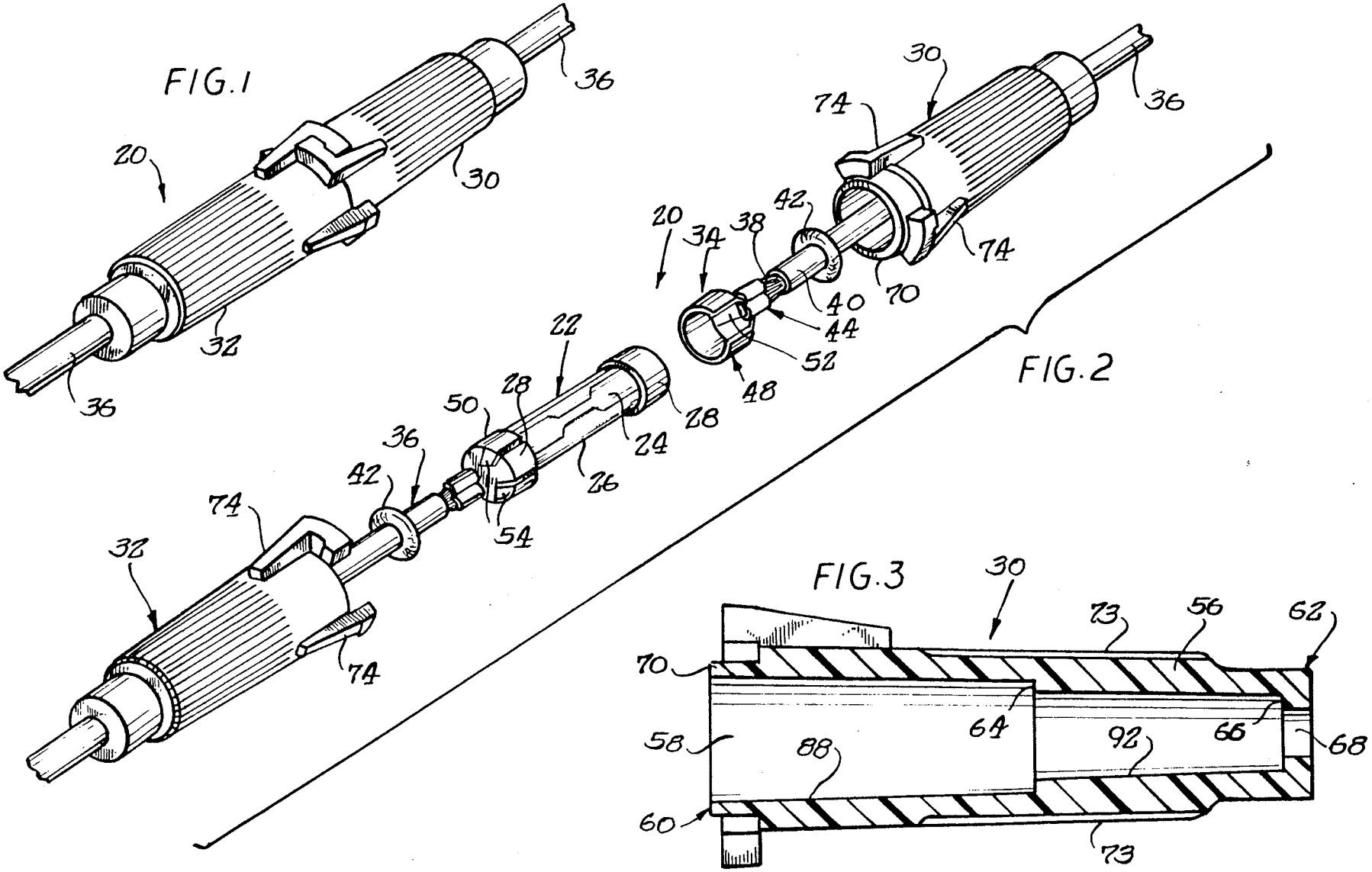
FIG. 1 is a perspective view of a fuse holder assembly for a cylindrical fuse having an insulative body made of a material such as glass or a ceramic incorporating various aspects of the present invention.
FIG. 2 is an exploded perspective view of the components of the assembly including a fuse, terminal elements for holding the fuse and connected to conductors, O-rings slidable on the conductors, and a pair of plastic end caps.
FIG. 3 is a longitudinal cross-sectional view of one end cap.
Figure 5:
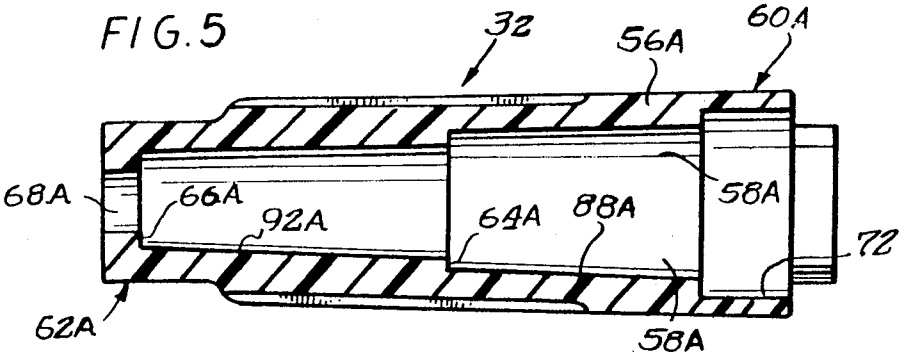
FIG. 5 is a longitudinal cross-sectional view of the other end cap.
Figure 6:
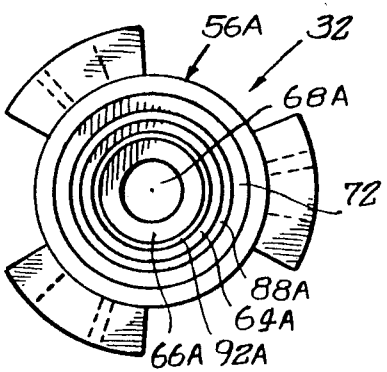
FIG. 6 is a right side elevational view of the other end cap.
Figure 7:
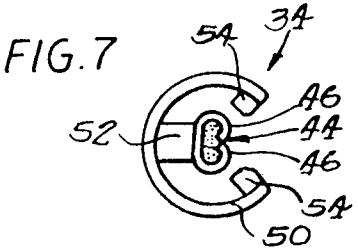
FIG. 7 is a side elevational view of a terminal element.

Referring now to the drawings, a fuse holder assembly embodying various aspects of the present invention is generally indicated in FIGS. 1 and 2 by reference numeral 20. The assembly is for a fuse 22 of the type including a fusible link 24 retained in an insulative body or sleeve 26 and with metallic terminal cups 28 held at the ends of the sleeve and connected to the ends of the link. The body is formed of a material such as glass or a ceramic. Such fuses are well known to those of skill i the art and need not be further discussed herein. Assembly 20 includes a first cap 30, best shown in FIGS. 3 and 4, formed of relatively rigid insulative material and a second cap 32, best shown in FIGS. 5 and 6, also formed of a relatively rigid insulative material. As the caps include many substantially identical components, components of cap 32 corresponding to components of cap 30 will be identified by the reference numeral assigned to the component of cap 30 with the addition of the suffix "A". The assembly 20 also includes first and second metallic terminal elements 34, first and second conductors 36 each including a metallic core 38 which could be formed by a number of wire strands and an insulative outer jacket 40, and a pair of sleeves 42 of resilient insulative material for receiving the conductors in an interference fit and being slidable on the outer surface of the jacket of its corresponding conductor.

Each terminal element 34 is preferably formed by cutting and bending or otherwise deforming a metallic blank. Each element includes a smaller end 44 for attachment to the core 38 of a conductor and may include a pair of arms 46 which can be crimped about the core using an appropriate crimping tool. Each terminal also includes a larger end 48 for receiving a terminal cup 28 of the fuse in an interference fit to establish good mechanical, thermal and electrical contact therewith. Larger end 48 could include a split ring 50 attached to the smaller end by a stem 52. The ring, which is resilient, can include an arcuate rib or dimples (not shown) on its inside surface to compressively engage an end cup. Inwardly directed tabs 54 at the end of the ring adjacent the stem serve to limit the extent of insertion of a fuse end cup 28 into the ring.

Figure 4:
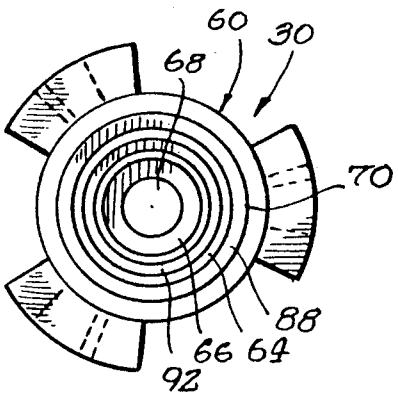
FIG. 4 is a left side elevational view of the one end cap.

Each cap 30, 32 is formed of a molded thermoplastic, a preferred material being TEXIN 4215, a registered trademark of the Mobay Corp. for polycarbonate/polyurethane. Referring to FIGS. 3 and 4, the first cap 30 includes a barrel 56 defining a cavity 58 for receiving a first terminal element 34. The cap 30 has an end portion 60 for facing the end portion 60A of the cap 32, and further includes a remote end portion 62. Cap 30 also includes an intermediate internal ledge 64 disposed between the end portions for abutting the split ring 50 of the terminal element 34. The remote end 62 includes a remote internal ledge 66 for abutting the first sleeve 42 and defining an opening for passage of the first conductor 36. Both internal ledges are preferably annular. The barrel 56 has a first interior surface 88 extending between the facing end 60 and the intermediate ledge 64, and a second interior surface 92 extending between the intermediate ledge 64 and the remote end portion 62. These interior surfaces preferably converge in the direction of the remote end portion 62 to facilitate release of the part from the mold. Additionally the barrel includes a number of regularly spaced, longitudinally extending ribs 73 on the barrel outer surface to assist the user in locking the caps together by twisting as will be further described hereinafter.

The sleeves 42 are preferably O-rings made of natural or synthetic rubber, a preferred material being 70 Buna. It has been found that for a conductor having a nominal outer jacket outside diameter of about 0.133 inch, an O-ring having an inside diameter of about 0.125 inch can be inserted over the conductor to compressively hold the conductor while being able to be slipped along the conductor due to engagement of the O-ring by the remote ledge 66 when the conductor is moved outwardly through the remote end portion opening 68. The engagement of the O-ring and the remote ledge provide a degree of water resistance at the remote end portion of the cap.

The facing end portion of the cap 30 includes an annular extension 70 while the facing end portion 60A of the cap 32 includes an annular depression 72 for receiving the extension in an interference fit. The extension and the interior surface defining the depression cooperate to provide a degree of water resistance at the location where the facing end portions of the caps abut. With the facing end portions engaging, the intermediate ledges 64 and 64A are spaced a distance substantially equal to the spacing between the terminal element split rings 50 when holding the terminal cup 28 of the fuse 22.

Figure 9:
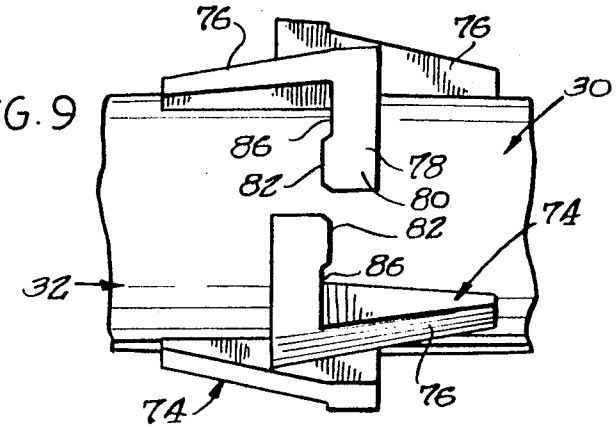
FIG. 9 is an enlarged fragmentary view of latching components of the two end caps.

Each of the caps 30 and 32 further includes interlocking means at its facing end portion 60 for locking the caps together upon relative rotation of the caps after engagement of the facing end portions 60, 60A. More specifically, the interlocking means are substantially identical and include a number of regularly spaced locking arms 74. As best shown in FIG. 9, each locking arm includes a support portion 76 on the outer surface of the corresponding cap, and a locking finger 78 extending normally to the longitudinal direction of the cap. Each finger 78 has a proximal end attached to the support portion 76 with the remainder of the finger being unattached to the cap and terminating in a distal end 80. The distal end is resiliently deflectable. The distal end includes an enlargement 82 extending toward the remote end portion 62 and with a surface of the finger located between the proximal and distal ends and facing the remote end portion having a depression 86 for seating the enlargement of a mating locking finger 78 of the other cap.

Figure 8:
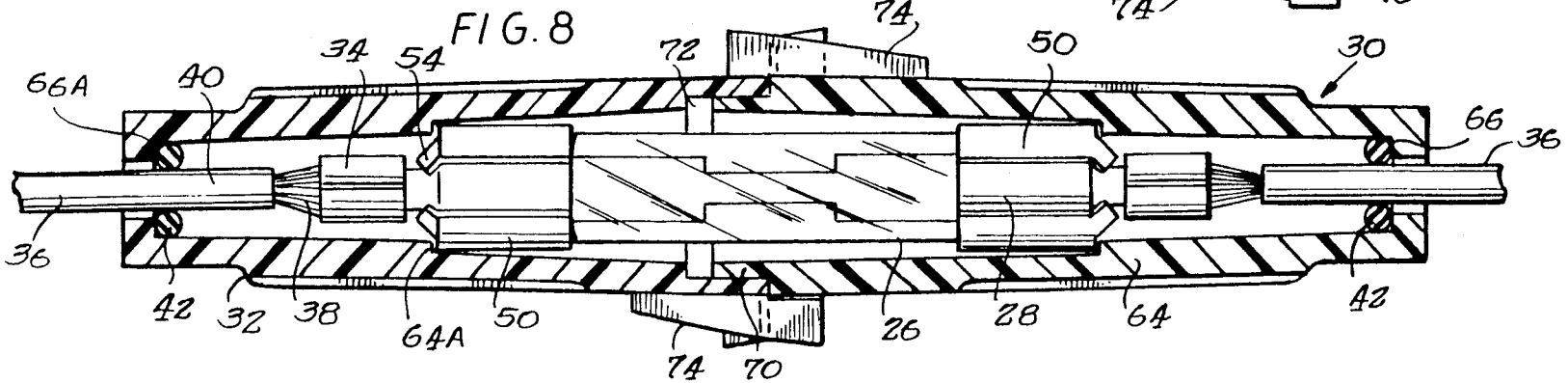
FIG. 8 is a longitudinal cross-sectional view of the assembled fuse holder.

Operation of the fuse holder assembly 20 is as follows. After each conductor 36 is inserted through the opening 68 at the remote end of the corresponding cap, an end portion of the outer jacket 40 is stripped away exposing the metallic core 38. The smaller end 44 of the terminal element 34 is then crimped on the exposed core. Of course, prior to the association of the terminal element and the conductor, the O-rings 42 are placed on the outer jackets of the conductors. After one end of the fuse 22 is inserted into one of the split rings 50, the caps 30 and 32 can be longitudinally moved together. This movement causes the remote ledges 66 to engage their respective O-rings, as shown in FIG. 8, and slide the rings along the outer jacket of the conductors until the other end cup 28 of the fuse is received in the remaining split ring 50 of the other terminal. The caps are continued to be longitudinally moved together causing the fuse to be firmly held in the resilient split rings 50 because the intermediate ledges 64 carry the split rings toward each other as the plastic caps are closed. After the facing end portions 60, 60A of the caps engage, the user merely effects relative twisting causing the fingers 78 to interlock thereby firmly holding the caps united. It will be appreciated, as shown in FIG. 8, that substantial longitudinal movement of the fuse is precluded due to the presence of the internal ledges 66, 66A. Thus when the fuse holder is fully assembled, the O-rings 42 bear on the remote ledges 66, 66A and the extension 70 is received in the depression 72, thereby providing a degree of water resistance at the ends of the caps where the conductors pass and where the caps join. While the fuse holder assembly 20 is not intended for underwater application, it will be appreciated that it will offer a degree of protection when used in an environment where water could occasionally drip or splash against the fuse holder. It should be appreciated that when the caps are unlocked and pulled apart, the caps can slide on the conductors 36 with the fuse 22 still held by the terminal elements 34 thereby protecting the glass sleeve 26.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

What is claimed is:

1. A fuse holder assembly for a fuse of the type including a fusible link retained in an insulative sleeve, made of a material such as glass or a ceramic, with a terminal cup, connected to an end of the link, at each end of the sleeve, said fuse holder assembly comprising:

first and second insulated conductors each having a conductive core and an insulative jacket positioned about said core;

a first metallic terminal element including a larger end for slidably receiving one of said terminal cups and a smaller end attached to the core of said first insulated conductor;

a second metallic terminal element including a larger end for slidably receiving the other terminal cup and a small end attached to the core of said second insulated conductor;

a first sleeve of resilient insulative material receiving in an interference fit said first conductor, said sleeve being slidable on the outside surface of the jacket of said first conductor;

a second sleeve of resilient insulative material receiving in an interference fit said second conductor, said sleeve being slidable on the outside surface of the jacket of said second conductor;

a first cap of relatively rigid insulative material including a barrel defining a cavity for receiving said first terminal element, said first cap having a facing end portion and a remote end portion, said first cap further including an intermediate internal ledge disposed between said end portions for abutting said larger end of said first terminal element and a remote internal ledge disposed at said remote end portion for abutting said first sleeve, said remote ledge defining an opening for passage of said first conductor; and a second cap of relatively rigid insulative material including a barrel defining a cavity for receiving said second terminal element, said second cap having a facing end portion and a remote end portion, said second cap further including an intermediate internal ledge disposed between the last-mentioned end portions for abutting said larger end of said second terminal element and a remote internal ledge disposed at said second cap remote end for abutting said second sleeve, said second cap remote ledge defining an opening for passage of said second conductor.

2. A fuse holder assembly as set forth in claim 1 wherein with the facing end portions of said caps engaging one another, said intermediate ledges are spaced a distance substantially equal to the spacing of said terminal element larger ends when holding said fuse whereby when said caps are moved toward each other the respective remote ledges engage and slide along a respective conductor jacket a respective sleeve until the facing end portions engage each other to hold said fuse from substantial longitudinal movement and with each sleeve closely adjacent its corresponding remote ledge to provide a degree of water resistance.

3. A fuse holder as set forth in claim 1 wherein said sleeves comprise O-rings.

4. A fuse holder as set forth in claim 1 wherein all of the aforementioned ledges are annular.

5. A fuse holder as set forth in claim 1 wherein the facing end portion of said first cap includes an annular extension, and wherein the facing end portion of the second cap comprises an annular depression for receiving said extension in an interference fit to provide a degree of water resistance.

6. A fuse holder as set forth in claim 2 wherein each of said first and second caps includes interlocking means at its facing end portion for locking said caps together upon relative rotation of said caps after engagement of said facing end portions.

7. A fuse holder as set forth in claim 6 wherein each interlocking means is substantially identical and comprises a plurality of regularly spaced locking arms, each locking arm including a support portion on the outer surface of its corresponding cap, and a locking finger extending normally to the longitudinal direction of its cap, said finger having a proximal end attached to said support arm with the remainder of said finger being unattached to said cap and terminating in a distal end, said distal end being resiliently deflectable.

8. A fuse holder as set forth in claim 7 wherein said distal end includes an enlargement extending toward the remote end portion of the corresponding cap and wherein a surface of the finger located between said proximal and distal ends and facing the remote end portion includes a depression for seating the enlargement of a mating locking finger of the other cap.

9. A fuse holder assembly for a fuse of the type including a fusible link retained in an insulative sleeve, made of a material such as glass or a ceramic, with a terminal cup, connected to an end of the link, at each end of the sleeve, said fuse holder assembly comprising:

a first metallic terminal element including a fuse-receiving end for slidably receiving one of said terminal cups and a conductor-receiving end for attachment to the core of a first insulated conductor;

a second metallic terminal element including a fuse-receiving end for slidably receiving the other terminal cup and a conductor-receiving end for attachment to the core of a second insulated conductor;

a first O-ring of resilient insulative material sized to receive in an interference fit said first conductor, said sleeve being slidable on the outside surface of said first conductor;

a second O-ring of resilient insulative material sized to receive in an interference fit said second conductor, said sleeve being slidable on the outside surface of said second conductor;

a first cap of relatively rigid insulative material including a barrel defining a cavity for receiving said first terminal element, said first cap having a facing end portion and a remote end portion, said first cap further including an intermediate internal ledge disposed between said end portions for abutting said fuse-receiving end of said first terminal element and a remote internal ledge disposed at said remote end portion for abutting said first O-ring, said remote ledge defining an opening for passage of said first conductor; and a second cap of relatively rigid insulative material including a barrel defining a cavity for receiving said second terminal element, said second cap having a facing end portion and a remote end portion, said second cap further including an intermediate internal ledge disposed between the last-mentioned end portions for abutting said fuse-receiving end of said second terminal element and a remote internal ledge disposed at said second cap remote end for abutting said second O-ring, said second cap remote ledge defining an opening for passage of said second conductor, with the facing end portions of said caps engaging each other, said intermediate ledges being spaced a distance substantially equal to the spacing of said terminal element fuse-receiving ends when holding said fuse, whereby when said caps are moved toward each other the respective remote ledges engage and slide along a respective conductor a respective O-ring until the facing end portions engage each other to hold said fuse from substantial longitudinal movement and with each O-ring closely adjacent its corresponding remote ledge to provide a degree of water resistance.

* * * * *